United States Patent [19]

Karashima

[11] 4,136,783

[45] Jan. 30, 1979

[54] SHOWCASE EQUIPMENT

[76] Inventor: Masashi Karashima, 40-7 Sangenjaya 2-chome, Setagaya-ku, Tokyo, Japan

[21] Appl. No.: 782,785

[22] Filed: Mar. 30, 1977

[30] Foreign Application Priority Data

Feb. 28, 1977 [JP] Japan ..... 52-20274
Feb. 28, 1977 [JP] Japan ..... 52-20275

[51] Int. Cl.[2] ..... A47F 5/00
[52] U.S. Cl. ..... 211/49 D; 211/151
[58] Field of Search ..... 211/49 D, 151, 134, 211/153; 108/32

[56] References Cited

U.S. PATENT DOCUMENTS

| | | | |
|---|---|---|---|
| 1,711,329 | 4/1929 | Short | 211/49 D |
| 1,715,276 | 5/1929 | Burns | 211/49 D |
| 1,749,843 | 3/1930 | Roark | 211/49 D |
| 1,757,076 | 5/1930 | Eckerly | 211/49 D |
| 2,891,677 | 6/1959 | Ritchie | 211/49 D |
| 3,399,784 | 9/1968 | Buchbinder et al. | 211/151 |
| 3,643,808 | 2/1972 | Ryan et al. | 211/49 D |

*Primary Examiner*—Roy D. Frazier
*Assistant Examiner*—Robert W. Gibson, Jr.
*Attorney, Agent, or Firm*—Wenderoth, Lind & Ponack

[57] ABSTRACT

An improved showcase which facilitates arraying and displaying goods on the shelves and base thereof. An inclined surface is formed on each shelf or base and a movable goods display member that is movable rearward and forward on each shelf is placed on each inclined shelf surface. In one preferred embodiment, the surface of the shelf or the base itself forms the inclined surface. In a modified embodiment, an auxiliary member having an inclined top surface inclined is mounted on the shelf or the base of the showcase and the movable goods display member is placed on the inclined top surface of the auxiliary member.

2 Claims, 22 Drawing Figures

SHOWCASE EQUIPMENT

The present invention relates to an apparatus for the display and sale of milk or various other foods in a supermarket or the like.

BACKGROUND OF THE INVENTION

Heretofore, the arraying or supplementing goods on shelves of a showcase or forwardly displacing goods from rear portions of shelves and a base of a showcase to their foremost portions was unexpectedly laborious.

To display a large variety of goods in good order, greatly burdens a worker, and it requires physically heavy labor, especially in a showcase. For the purpose of increasing a capacity, a base at the lowest level is lowered and a position of a shelf at the top level is raised. Consequently, arraying or supplementing goods on the base of the showcase is inefficient, and also the physical burden on the worker is large.

Likewise, the time and labor required for supplementing goods to be displayed at the top level and forwardly displacing the goods are also large.

In general, there is a tendency that goods displayed in a showcase are sold starting from the front portion of the showcase, and always old goods remain unsold and stay long at the innermost portion of the showcase.

Recently, refrigerator cases or cold-storage cases have been widely used for display and sale of goods, and in this case, not only the same shortcoming as described above arises, but also the works of arraying goods up to the rear wall surface or, on the contrary, taking out the goods placed deeper than is conducted center in the case up to the front portion to re-array the goods by inserting hands into the cold-storage case. The worker gets cold in this situation.

Also, in refrigerated cases, the temperature within the case is often lower than −10° C., and so, physical hindrance caused by working in these conditions is increased.

SUMMARY OF THE INVENTION

Accordingly, it is one object of the present invention to provide an improved showcase that is free from the above-described disadvantages.

In order to achieve the above-mentioned object, the showcase according to the present invention is characterized in that an inclined surface is formed on a shelf or base of the showcase and a movable goods display member that is movable in the direction of the depth of the showcase is placed on this inclined surface.

Since the showcase according to the present invention is constructed as described above, during arraying and supplementing the goods, the movable goods display member is drawn up to the front of the shelf or base of the showcase, goods are loaded thereon, and subsequently the movable goods display member displaces up to the neighborhood of the innermost wall surface of the showcase. The goods are thereby arrayed on the shelf or base in front of said movable good display member.

Then, as the goods arrayed on the front portion of said shelf or base are sold, the movable goods display member which is movable in the direction of the depth of the case will move forwardly along the inclined surface on said shelf or base under the action of gravity.

Thus, when the goods loaded on the movable goods display member displaced to the front portion of the shelf or base have been sold, goods are newly arrayed on the member and subsequently the same operations as described above are repeated.

As described above, the basic advantages of the present invention are as follows: an inclined surface is formed on a shelf or base in a showcase and a movable goods display member which is movable in the direction of the depth of the showcase is placed on this inclined surface; after the goods have been arrayed on this movable goods display member that member displaces up to the neighborhood of the innermost wall of the showcase equipment; the goods are further arrayed on the shelf or base in the front portion of the showcase equipment, whereby as the goods in the front portion of the showcase are sold, the movable goods display member (still loaded with the goods) automatically displaces to the front portion of the showcase under the action of gravity; the goods placed in the rear portion of the showcase equipment naturally displace forward; and while the goods on the goods display member, which has been thus displaced to the front portion of the showcase are being sold, the arraying and supplementing of the goods on the base and shelves of the showcase equipment are carried out efficiently; the burden upon the worker is widely reduced; and since the goods in the showcase are always sold from the front, there is no fear that old goods maybe left unsold or stay for long periods of time at the innermost portion of the showcase.

The showcase according to the present invention may be constructed in such manner that an auxiliary member having its top surface inclined is mounted on the shelf or base of the showcase and the movable goods display member will be placed on the inclined top surface of said auxiliary member. By using the auxiliary member, the present invention may be incorporated into an existing showcase and it will also be possible to form an inclined surface having a desired gradiant on the shelf or the base by appropriately selecting the auxiliary member.

In addition, the showcase according to the present invention may be constructed in such a manner that the surface of the shelf or base of the showcase is inclined. A partition member or members which extend in the direction of the depth are then positioned on said shelf or base. In the space partitioned by the partition member, a movable goods display member, that is movable in the direction of depth, will be placed on the inclined surface of the shelf or base. Then when different kinds of goods are to be displayed or a large number of these of goods are to be displayed, because the display space above the shelf or base is partitioned by the partition members and the goods are displayed and sold in divided sections, handling of the goods will be facilitated.

Furthermore, the showcase according to the present invention may be constructed in such a manner that a partition member or members which extend in the direction of depth will be disposed on the shelf or base of the showcase, an auxiliary member having its top surface inclined will be mounted on the shelf or base within the space partitioned by the partition member, and a movable goods display member that will be movable in the direction of depth is placed on the inclined top surface of the auxiliary member. Then even if the present invention is incorporated into an existing showcase, the sectioned display and sale of the goods is possible in a manner similar to the above-described case. Also when different kinds of goods are displayed, it is possible to selectively utilize the showcase according to the present invention only for desired goods by mounting the auxiliary member on the shelf or base only in those partitioned space in which the desired goods are to be displayed and by placing the movable goods display member on the auxiliary member.

The movable goods display member maybe, a panel or basket provided with wheels or rollers, to roll over the inclined surface on the shelf or base or the inclined surface on the auxiliary member, or it maybe a panel or basket for provided with sliders to slide along each the inclined surfaces.

BRIEF DESCRIPTION OF THE DRAWINGS

Now the present invention will be described in connection to its preferred embodiments illustrated in the drawings, in which.

DETAILED DESCRIPTION OF THE INVENTION

Figure 1A:
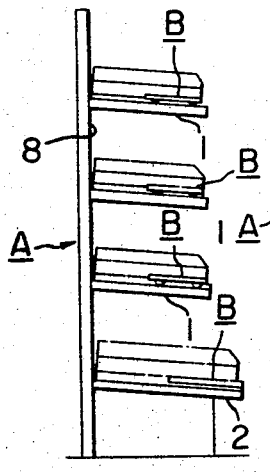
FIGS. 1A through 1G are side views showing the process of arraying and supplementing goods in one preferred embodiment of the present invention as applied to a showcase.
Figure 1B:
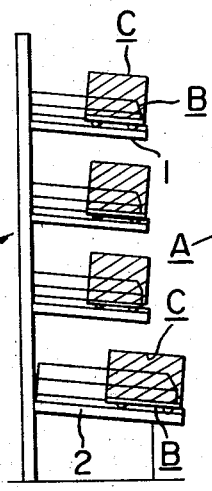
Figure 1C:
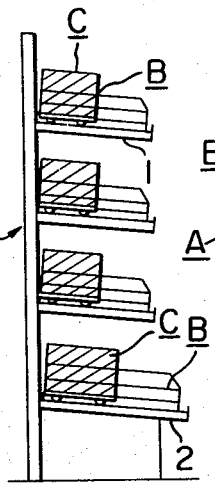
Figure 1D:
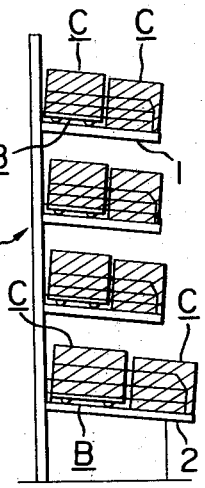
Figure 1E:
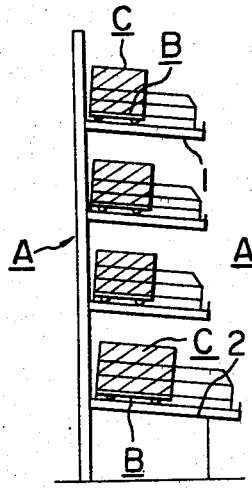
Figure 1F:
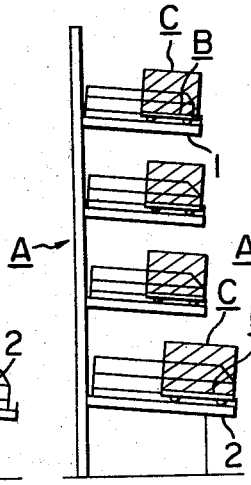
Figure 1G:
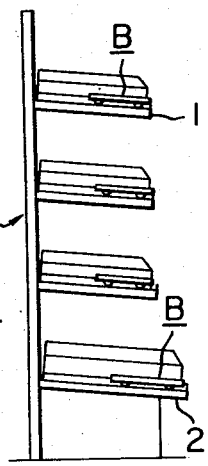
Figure 2:
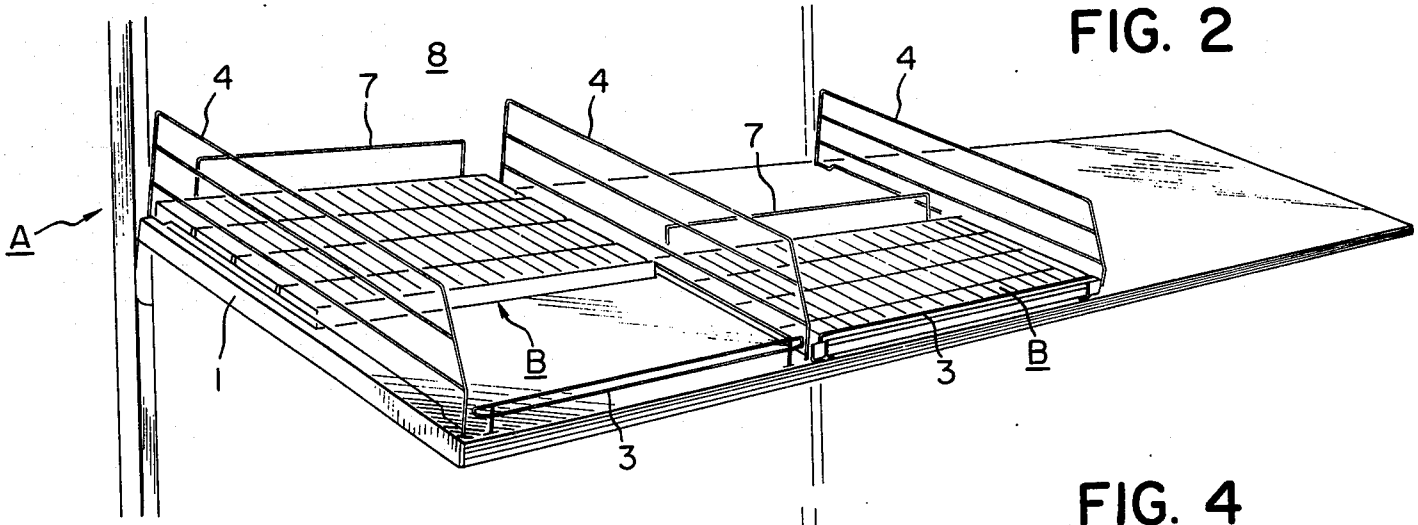
FIG. 2 is an enlarged perspective view of an essential part of the showcase in FIG. 1.

Referring now to the drawings, in FIGS. 1 and 2 reference numerals 1 and 2 designate a shelf and a base, respectively, in a showcase (A). The upper surfaces of these members are formed as inclined surfaces having an inclination angle of 1° to 20° depending upon the weight and shape of the goods to be displayed. At the front edges of the inclined surfaces, front frames 3 are mounted for preventing the goods from slipping and falling, and in the direction of width of the showcase partition frames 4 are mounted for the displaying different kinds of goods in divided sections for the respective kinds of goods. Also a large number of same kind of goods maybe divided into groups each consisting of a predetermined number of goods. These side portion frames 4 also preventing the goods from falling down side of the showcase.

Reference character (B) designates a panel for displaying goods which forms a movable goods display member, in which wheels 6 are mounted on the back side of a main plate 5 to on which the goods are loaded. A handle 7 at the rear edge of the main plate also serves to prevent the goods from falling. 5 (See FIG. 6.).

When goods (C) such as foods or the like are arrayed and supplemented in the showcase (A), the panel (B) is drawn out up to the front edge of the shelf 1 or the base 2 (See FIG. 1A.), the goods (C) are loaded on the panel (B) (See FIG. 1B.); subsequently the panel (B) is displaced up to the neighborhood of a surface of an innermost wall 8 (See FIG. 1C.); and the goods (C) are arrayed on the front portion of the shelf 1 or the base 2 in front of said panel (B) (See FIG. 1D.).

As the goods (C) are being sold successively starting from the one displayed at the foremost position on the shelf 1 or the base 2 (See FIG. 1E.), the panel (B) will move forwardly along the inclined surface of the shelf 1 or the base 2 under the action of gravity (See FIG. 1F.). Although the goods (C) are illustrated in FIGS. 1A to 1G (in FIGS. 3A to 3G and FIGS. 5A to 5C, too) as if they are so large that only one of them occupies the whole panel (B) and the front portion of the shelf 1 or the base 2 is filled by only one of the goods (C). In general, a number of smaller goods (C) are arrayed in rows and columns on the panel (B) and likewise a number of smaller goods (C) are arrayed in rows and columns on the front portion of the shelf 1 or the base 2. Therefore, as the goods on the front portion of the shelf 1 or the base 2 are sold, the panel (B) having a number of goods (C) loaded thereon moves forward when the rearmost row on the front portion is cleared.

In this way, when the goods (C) on the panel (B) which was displaced to the foremost position on the shelf 1 or the base 2 are sold (See FIG. 1G.), the goods (C) are newly arrayed on the panel (B), and then the same operations as described above are repeated.

Figure 4:
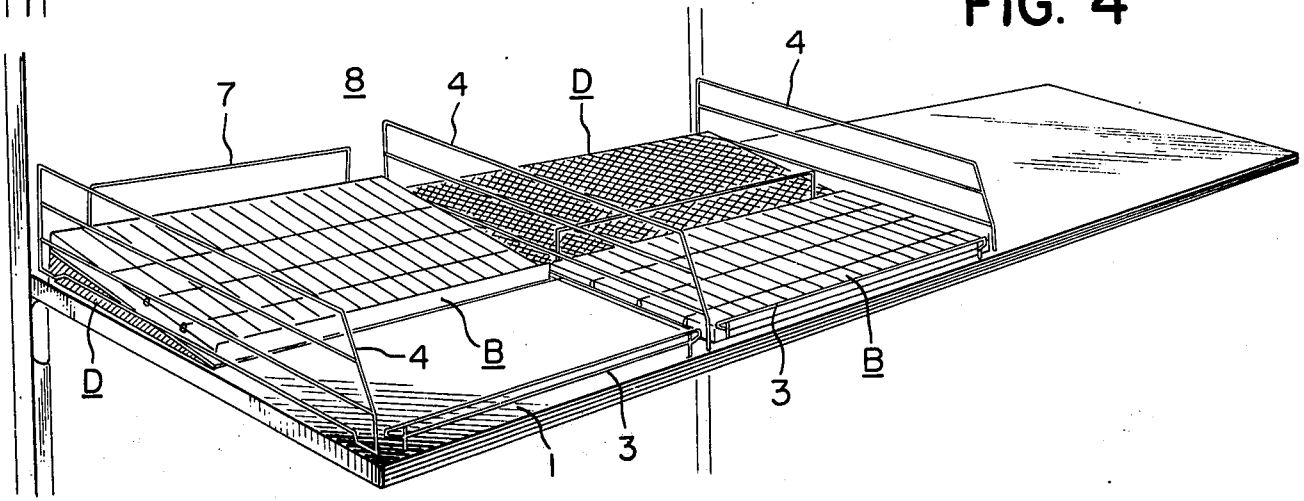
FIG. 4 is an enlarged perspective view of an essential part of the showcase in FIG. 3.
Figure 3A:
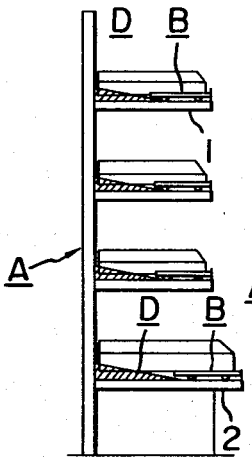
FIGS. 3A through 3G are side views showing the process of arraying and supplementing goods in another preferred embodiment of the present invention as applied to a showcase.
Figure 3B:
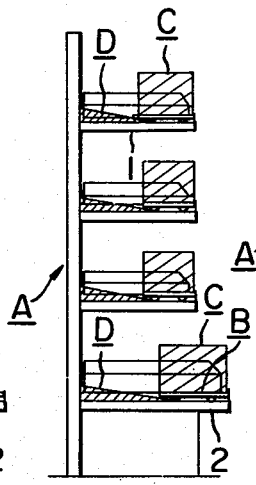
Figure 3C:
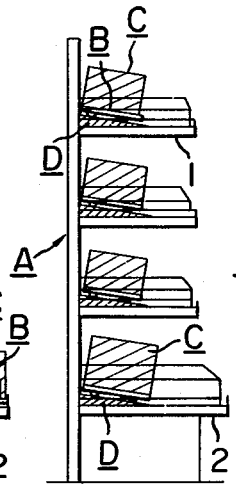
Figure 3D:
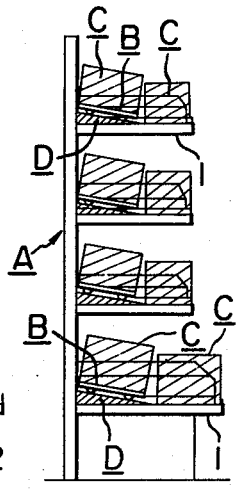
Figure 3E:
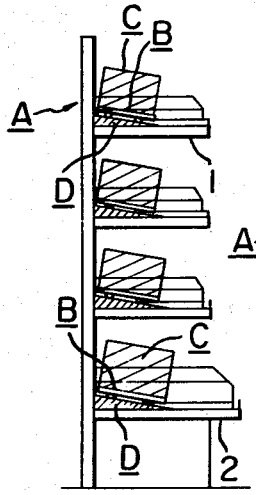
Figure 3F:
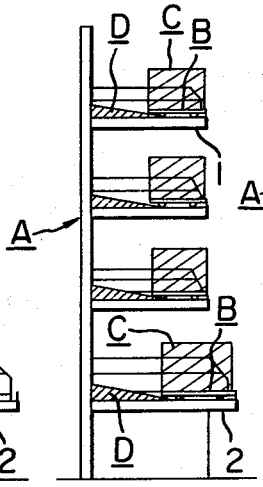
Figure 3G:
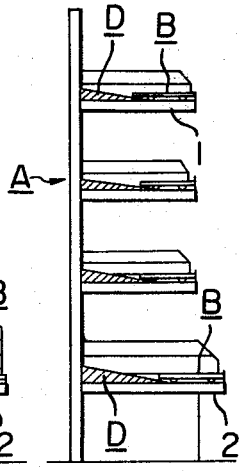
Figure 7:
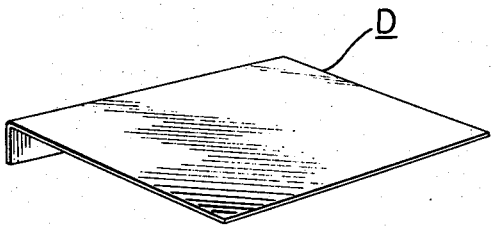
FIG. 7 is a perspective view of an auxiliary member.

Next when a present invention is applied to the conventional showcase which has shelves 1 and a base 2 whose upper surfaces are formed horizontally, auxiliary members (D) having their top surfaces formed in an inclined surface having a desired inclination angle (See FIG. 7.) are mounted on the shelves 1 and the base 2 as shown in FIG. 4. The above-mentioned panels (B) are placed on these auxiliary members, respectively. It is to be noted that the above-mentioned auxiliary members (D) may be mounted on the rear half portions of the shelves 1 and the base 2, or else they could be mounted over the entire lengths in the direction of depth of these shelves 1 and the base 2.

The work arraying and supplementing of the goods (C) when the auxiliary members (D) are employed is carried out exactly the same way as the first embodiment, as illustrated in FIGS. 3A through 3G, and therefore, further explanation will be omitted. It is noted that throughout the drawings, component parts equivalent to each other are given like reference characters or numerals.

Figure 8:
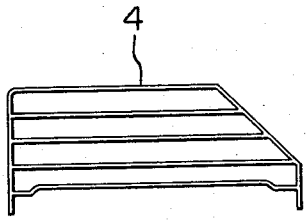
FIG. 8 is a side view of a partition plate.

In FIG. 5, reference numerals 1 and 2 designate shelves and a base, respectively, in a refrigerator case (A'). The upper surfaces of these members are formed as an inclined surface having an inclination angle of 1° to 20° depending upon the weight and shape of the goods to be displayed. Along the front edges of these members are front frames 3 for preventing the goods from slipping and falling, and partition frames 4 (See FIG. 8.) are mounted on these members in the direction of the depth for the purpose of displaying different kinds of goods in divided sections for the respective goods, or for displaying a large number of the same kind of goods in divided groups each consisting of a predetermined number of goods. The portion frames also prevent the goods from falling down the side of the refrigerator case.

Figure 5A:
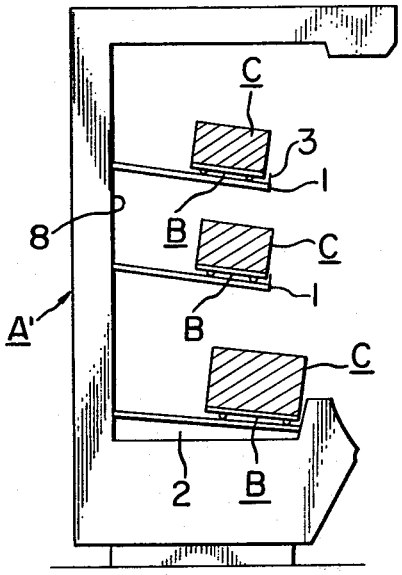
FIGS. 5A through 5C are side views showing the process of arraying and supplementing goods in yet another preferred embodiment of the present invention as applied to a refrigerator cold-storage case.
Figure 5B:
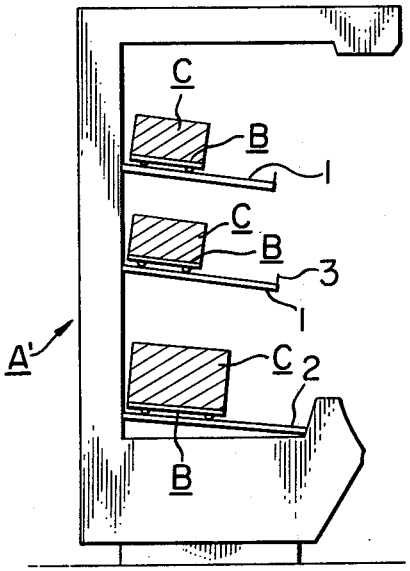
Figure 5C:
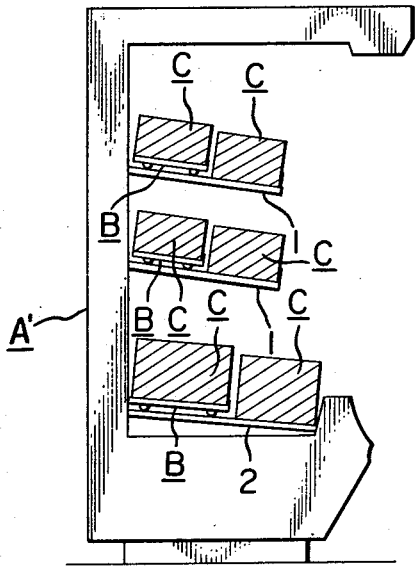
Figure 6:
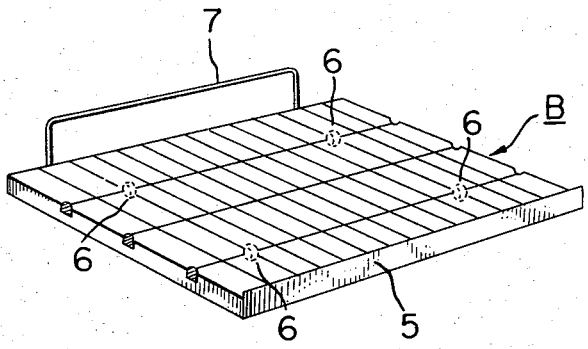
FIG. 6 is a perspective view of a panel for displaying goods.

When the goods (C) are arrayed and supplemented in the above-described refrigerator cold-storage case (A'), the panel (B) as shown in FIG. 6 is drawn out up to the foremost position on the shelf 1 or the base 2 to be loaded with the goods (C) (See FIG. 5A.). Subsequently, the panel (B) is displaced up to the neighborhood the surface of the innermost wall 8 along the shelf 1 or rest of the the base 2 (See FIG. 5B.), and the goods (C) are arrayed on the front portion of the shelf 1 or the base 2 in front of the panel (B) (See FIG. 5C.).

Then, as the goods (C) are sold successively starting from the one displayed at the foremost position on the shelf 1 or the base 2 (See FIG. 5B.), the panel (B) moves forwardly along the inclined surface of the shelf 1 or the base 2 under the action of gravity (See FIG. 5A.).

In this way, when the goods (C) on the panel (B) which was displaced to the foremost position on the shelf 1 or the base 2 have been sold, the goods (C) are newly arrayed on the panel (B), and then the same operations as described above are repeated.

When the present invention is applied to the conventional refrigerator cold-storage cases which have shelves 1 and a base 2 whose upper surfaces are horizontal, the above-described auxiliary members (D) are mounted on the shelves 1 and the base 2 similarly to the second embodiment shown in FIGS. 3 and 4, and the panels (B) are placed on these auxiliary members (D). As in the case of the second embodiment, it is to be noted that the above-mentioned auxiliary members (D) may be mounted on the rear half portions of the shelves 1 and the base 2, or else they may be mounted over the entire lengths in the direction of depth of these shelves 1 and the base 2.

The arraying and supplementing of the goods (C) in the refrigerator cold-storage case when the auxiliary members (D), are employed is carried out exactly in the same way as the above-described embodiments; and therefore, further explanation of the work will be omitted.

While the present invention has been described above in connection with its preferred embodiments, the invention should not be limited to these embodiments. Various changes and modifications in design may be made without departing the spirit of the present invention.

What is claimed is:

1. A showcase for goods comprising:

a plurality of horizontal shelves;

surface inclining means on said shelves at the rear edge thereof for providing an inclined slope from the rear of each shelf to the front of each shelf; and movable goods display means on said shelves and said surface inclining means for supporting goods thereon and for moving said goods rearward and forward on said shelves and said surface inclining means.

2. A showcase as claimed in claim 1, further comprising partition means positioned at predetermined intervals along the length of said shelves for dividing said shelves into a plurality of individual segments; and wherein said movable goods display means and said surface inclining means are positioned between said partition means on said shelves.

* * * * *